US005199544A

United States Patent [19]

Lenander et al.

[11] Patent Number: 5,199,544

[45] Date of Patent: Apr. 6, 1993

[54] COIN OPERATED LOCK FOR DELIVERING A LOCKING MEANS SECURED IN SAID LOCK

[75] Inventors: Aage Lenander, Horsholm; Bertil Engstrom, Graested, both of Denmark

[73] Assignee: Catena Systems APS, Denmark

[21] Appl. No.: 678,965

[22] PCT Filed: Dec. 20, 1989

[86] PCT No.: PCT/DK89/00299

§ 371 Date: Aug. 15, 1991

§ 102(e) Date: Aug. 15, 1991

[87] PCT Pub. No.: WO90/07167

PCT Pub. Date: Jun. 28, 1990

[30] Foreign Application Priority Data

Dec. 20, 1988 [DK] Denmark ..... 7103/88

[51] Int. Cl.[5] ..... G07F 17/00

[52] U.S. Cl. ..... 194/212; 194/252; 194/905

[58] Field of Search ..... 194/212, 252, 905

[56] References Cited

U.S. PATENT DOCUMENTS

| | | | |
|---|---|---|---|
| 522,943 | 7/1894 | Patterson | 194/252 |
| 2,818,956 | 1/1958 | Lukens | 194/252 |
| 3,966,033 | 6/1976 | Doo | 70/58 X |

FOREIGN PATENT DOCUMENTS

| | | | |
|---|---|---|---|
| 3242045 | 5/1984 | Fed. Rep. of Germany . | |
| WO/04835 | 12/1984 | World Int. Prop. O. | 194/905 |

*Primary Examiner*—F. J. Bartuska

*Attorney, Agent, or Firm*—Silverman, Cass & Singer, Ltd.

[57] ABSTRACT

A lock operated by the introduction of a coin into a chamber in the lock. A scanning member scans the size of the introduced coin. The scanning member includes at least one recess for receipt of a releasing member adapted to move into said recess to cause release of a locking member to permit removal thereof from the lock.

6 Claims, 3 Drawing Sheets

COIN OPERATED LOCK FOR DELIVERING A LOCKING MEANS SECURED IN SAID LOCK

Figure 1:
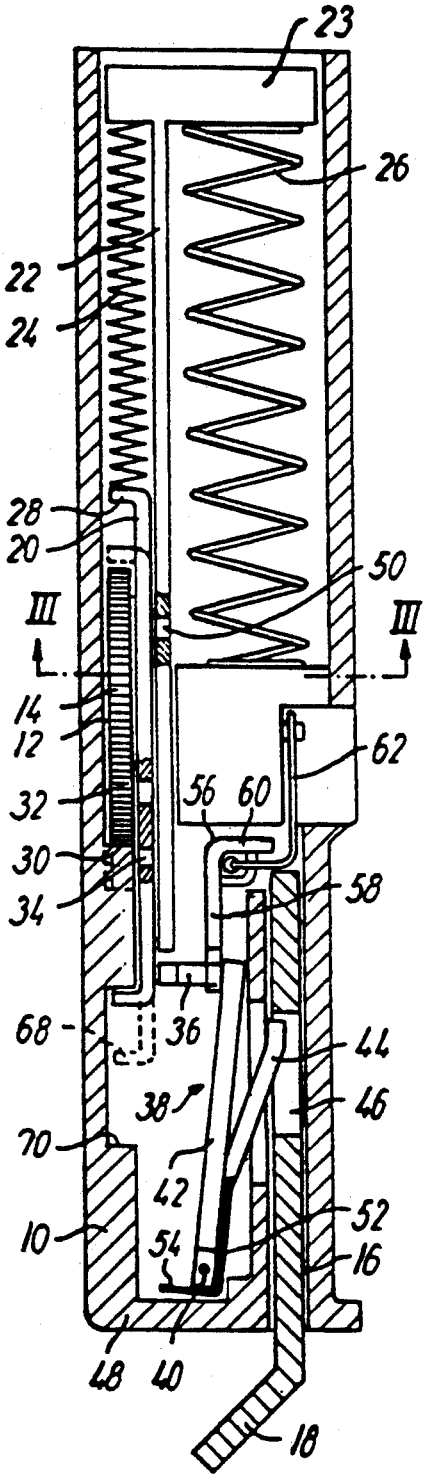

The invention concerns a coin operated lock for delivering a locking means secured in said lock after the introduction of a means of payment, for example a coin, into said lock, as said lock comprises a chamber for receiving the locking means, members for securing the locking means in the chamber, a chamber for receiving a means of payment, and members for delivering the locking means after the introduction of the means of payment.

Locks of this kind are e.g. used in connection with shopping or similar carriages which can be borrowed by releasing them from an anchoring system provided by means of the locking means, after having put a means of payment into the lock, and where the introduced means of payment is payed back when again returning an re-anchoring the carriage.

It is the object of the invention to provide a lock of the kind disclosed adapted to decide by itself, whether the means of payment inserted has the right size, and thus the correct value.

According to the invention, this is obtained by the fact that a scanning member belonging to the chamber for the means of payment is adapted to scan, during a displacement movement the size of an inserted means of payment in the direction of the displacement movement of the scanning member, and corresponding to one or more of such sizes is provided with one or more recesses or passages for receiving a releasing member attached to the chamber for the locking means and adapted to get into an engagement connection with the recesses or passages in the scanning member in such a manner to cause the releasing of the locking means in order to remove it from the chamber of the locking means.

Thus, the control of the right size of the means of payment and thus of its correct value is carried out as the initial step of an operating manipulation which, after all, is necessary in order to release the locking means. This means that the control does not take extra time. Moreover, the structure according to the invention makes it possible to easily adapt the control mechanism to different sizes of means of payment and that the entire structure of the lock can be made space saving and robust.

According to the invention, the scanning member can consist of a measuring member and a movement member which are coupled together to the movement both at the same time and in relation to each other, the measuring member being provided with the recess or the passage or the recesses or passages, and the movement member having a passage for the releasing member for an engagement connection with the passage and a recess or passage when they occupy a displacement position aligned to each other. This embodiment allows a specific space saving structure, as the measuring member and the movement member can be formed as guides and slides positioned side by side.

According to the invention, the releasing member can be shaped as a pivotable member having a projection protruding to the one side of the pivot level for engagement with the passage and the recess or passage and a projection protruding to the opposite side in order to secure a locking means by means of which it may, during the rotation of the member, protrude into the chamber of the locking means. Also this structure can be formed simply, space-saving and robust.

According to the invention, the releasing member can be actuated by a spring which is active in the movement level of the locking means and which at the same time is protruding into the movement level of the movement member. When the spring is actuated by the movement member, the spring force can be used to clamp the releasing member and the parts of the scanning member in the releasing position. Moreover, this arrangement also means that the actuating does not take place before the movement member has approached or arrived at its active outmost position. Thus, it is avoided that the movable parts are getting into unnecessary wear-affording displacement-touch with each other.

According to the invention, an auxiliary member is attached to the releasing member for disconnectingly locking the releasing member in the position of securing the locking means and releasing the locking means, respectively, whereby a correct functioning of the lock is ensured.

According to the invention, the releasing member can, with the purpose of locking, be actuated by a spring placed in the chamber of the locking means and shaped in such a way to apply an ejecting impulse on the locking means.

Finally, according to the invention, the scanning member can have a terminating surface extending transversely to the displacement path of the member for co-operating with an edge of the means of payment and adapted to form, in the resting position of the lock, a limitation surface for a chamber for receiving a means of payment and which is provided with a groove arranged between the side edges in order to receive a circumferential part of the means of payment. Thus, the scanning means co-operates with the means of payment edge by edge and consequently, the forces of displacement are transmitted via a narrow area of contact. Therefore, it will become difficult or even impossible to use false means of payment of a relatively weak material such as cardboard.

Figure 2:
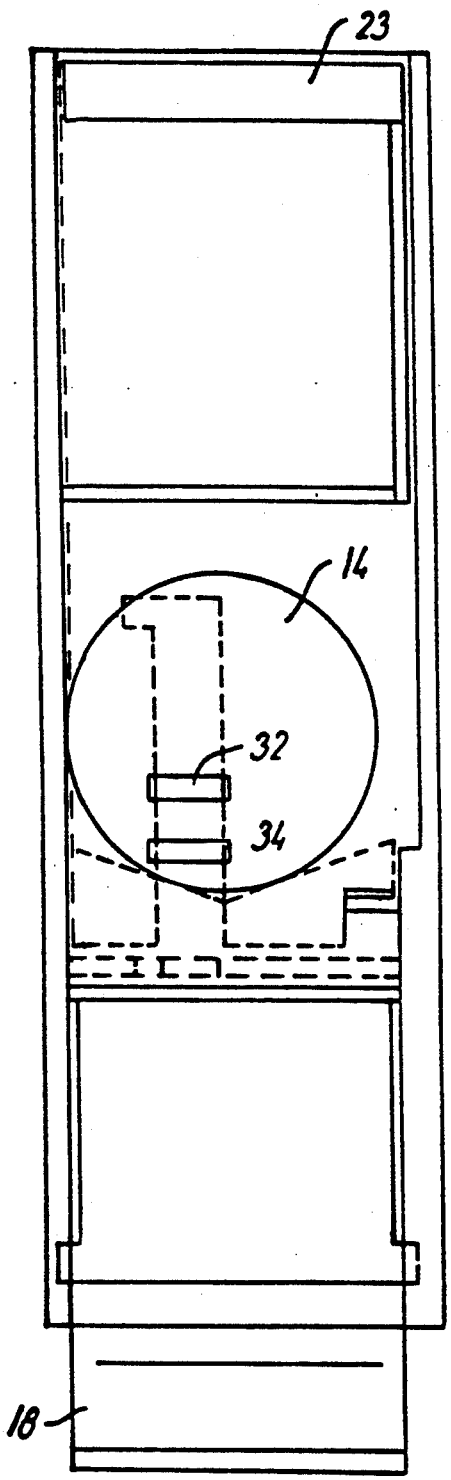
Figure 3:
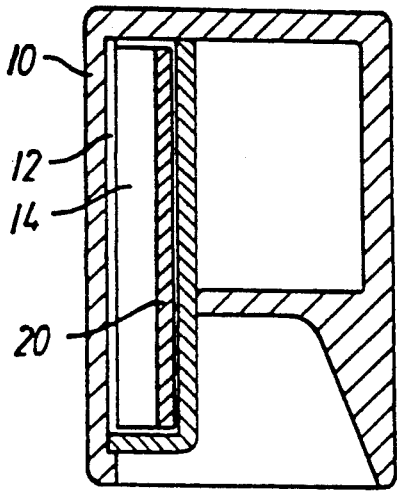
Figure 4:
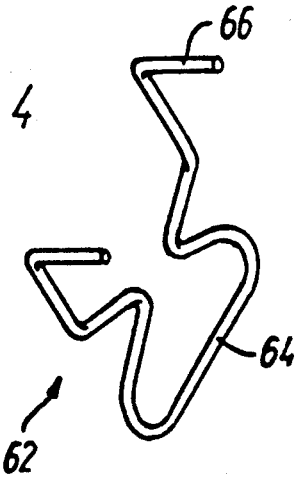
Figure 5:
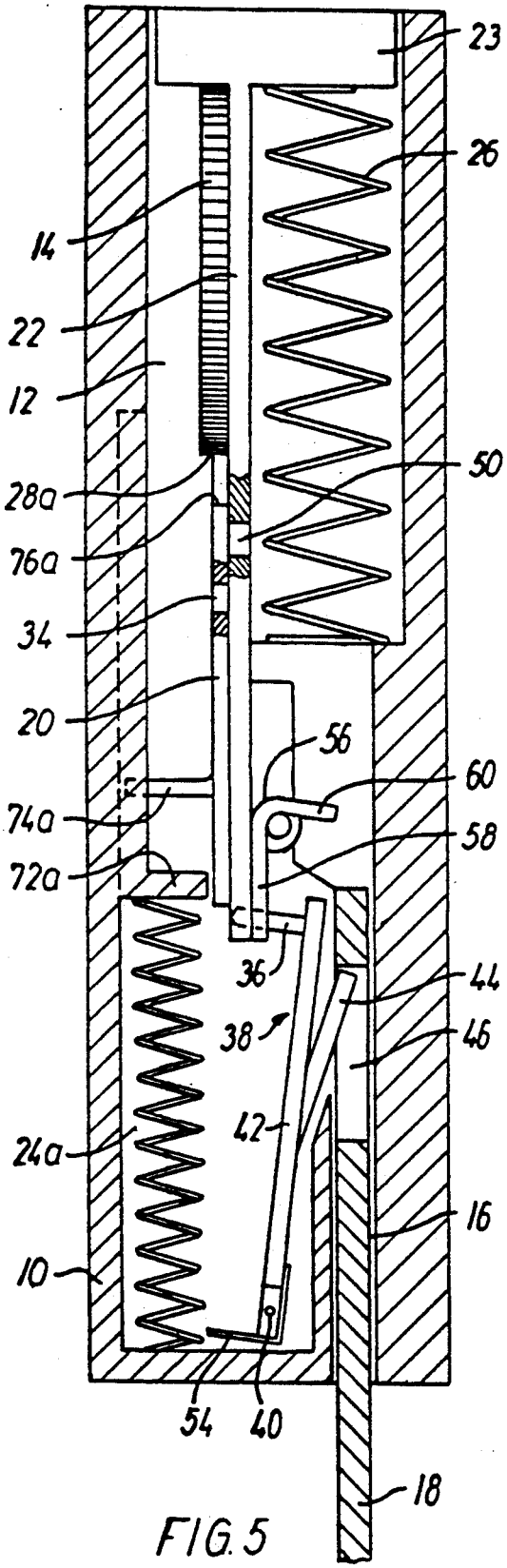
Figure 6:
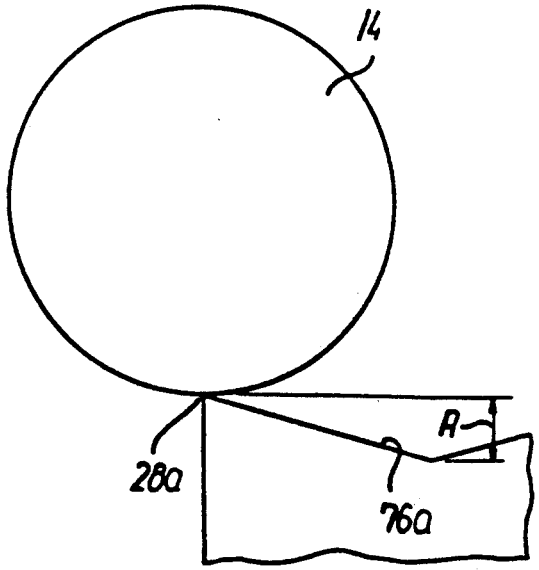

The invention will be explained by the following details, reference being made to the accompanying drawing, on which FIG. 1 shows schematically an embodiment of the coin operated lock according to the invention, partly seen from the side and partly in longitudinal section, FIG. 2 shows schematically the same, seen from ahead, FIG. 3 a section following the lines III—III of FIG. 1, and FIG. 4 in a larger scale an ejecting spring, FIG. 5 shows schematically another embodiment of the coin operated lock, and FIG. 6 shows schematically a detail of that embodiment.

An oblong housing 10 has a chamber 12 for receiving a means of payment 14, here shown as a coin, a chamber 16 for receiving a locking means 18, here shown as a key, and members for delivering the locking means 18 after the introduction of the means of payment 14.

These members comprise a scanning member consisting of a scanning slide 20, and a main slide 22, which at its upper end is provided with a control head 23. The slides 20 and 22 can be displaced both at the same time and in relation to each other by pushing the slide 22 by means of the effect of pressure springs 24 and 26 into the housing 10. As it is shown, the spring 24 actuates the scanning slide 20 while the spring 26 actuates the main slide 22. The springs 24 and 26 can also be shaped in one piece.

The scanning slide 20 has an upper projection 28 protruding into the chamber 12 of the coin 14. The chamber has a bottom 30 the introduced coin is abuting against. During the downwards displacement of the main slide 22, and thus of the of the scanning slide 20 towards the effect of the springs 24 and 26, the projection 28 of the scanning slide 20, as shown with the dotted lines, comes to abut against the end of the coin 14 situated opposite of the bottom 30, and thus the dimension of the coin is scanned in the direction of the displacement path of the scanning slide 20.

Corresponding to the sizes of the coins to be accepted by the coin operated lock, the scanning slide 20 is provided with recesses in the form of apertures, in the present case two, 32 and 34. The disposition is made in such a way that whether the size of the coin corresponds to the position of the one or the other of those apertures, the aperture in question will in the scanning position be placed opposite a projection 36 which is attached to a releasing member, generally designated 38. This member is, in the drawing level, pivotable around a shaft 40, and it has a protruding body 42, which at the top is bearing the projection 36 protruding to the left towards the scanning slide 20, and on the opposite side has a projection 44 protruding to the right into the chamber 16 of the locking means 18 and, in the shown situation, into an aperture 46 of a key 18 introduced into the chamber 16, thus being secured in the chamber 16.

By pushing the main slide 22 down, thus causing displacement of the scanning slide 20 towards the scanning position of the projection 28 shown with dotted lines, first the aperture 34 of the scanning slide 20 which is relevant for the result of the scanning is aligned with the projection 36 of the releasing member 38. By continously pushing the main slide 22 down until it hits the bottom of the housing 10, another aperture 50 shaped in the main slide 22 at an appropriate place is aligned with the aperture 34 and the projection. By means of a spring 52, the releasing member 38 is now able to pivot counter-clockwise and lead its projection 38 into the apertures 50 and 34, thus the slides 20 and 22 being secured. At the same time the projection 44 of the releasing means 38 is removed from the chamber 16 of the locking means, thus releasing the key 18.

As it appears from the drawing, the spring 52 is provided with an angular leg protruding to the left and into the movement path of the main slide 22. That means that the releasing member with its projection 36, the scanning slide 20 and the main slide 22 by means of the spring power performed when the slide 22 at the bottom depresses the leg 54, are secured compactly to each other, while the members until now were able to move freely in relation to each other, thus the risk for wearing and tearing each other being reduced.

An auxiliary member in the form of an angular tilt 56 is attached to the releasing member 38 and embedded in a shaft of spring steel arranged in the angular aperture. The one leg 58 of the tilt 56 is grasping the projection 36 of the releasing member 38 while the other angular leg 60 of the tilt 56 is actuated by a spring 62 which, in a larger scale, is shown in FIG. 4. This spring 56 is arranged at the upper end of the chamber 16 of the locking means. The central hoop 64 of the spring 62 is protruding into the chamber 16, while the leg 66 of the spring is co-operating with the projection 36 of the releasing member 38. Hereby it is partly obtained that the spring 62 by means of the central hoop 64 —which because of its shape and position is pressure-actuated by the key 18 when said key is pushed up into the chamber 16 —when releasing the key will be able to confer an ejecting impulse to it, partly that the spring power from the legs 66 can keep the projection of the releasing member 38 in mesh with a locking means introduced into the chamber 16 and by overcoming the spring power of the legs can co-operate in controlling the releasing member 38 for a safe engagement connection with the slides 20 and 22.

As it also appears from FIG. 1, the lock is secured against the removal of a key as long as no coin is inserted, since the scanning slide 20 will be displaced entirely downwardly with a lower projection abuting on an internal stop 70 in the housing 10, when the main slide 20 is pushed downwardly, said stop 70 being positioned so low that both apertures 32 and 34 of the scanning slide 20 will have passed the flushing line with the projection 36 of the releasing member 38, which means that the latter will not be able to pivot into a left, key (18)—releasing position.

The embodiment shown in FIG. 5 is constructed according to the same principles of function as the embodiment according to FIG. 1. However, it shows some structural divergences which are emphasized by the letter a added to the reference numerals.

Instead of the tension spring according to FIG. 1, the spring controlling the scanning slide 20 is now formed as a pressure spring 24a, which abuts the bottom of the housing 10 with its lower end, and the upper end of which abuts a stop 72a in the housing, in its starting position. At its lower end, the scanning slide 20 is provided with a foot 74a, by means of which it can step on the spring 24a.

The function of the projection 28 in FIG. 1 is now transferred to the upper terminating surface 28a of the scanning slide 20, which is provided with a V-shaped recess 76 having a depth A, vide FIG. 6.

The scanning slide 20 shows only one single aperture 34 in the form of a hole, the positioning of which in the scanning slide 20 corresponds to the size of the shown coin 14a.

In the starting position, the scanning slide 20 is lifted by means of a not-shown auxiliary connection with the main slide 22 to such an extent that its foot 74a gets free from the upper end of the pressure spring 24a. Thus, an unnecessary wear of the elements is avoided. As illustrated in FIG. 5, the coin 14 is inserted between the lower surface of the head 23 of the main slide 22 and the terminating surface 28a of the scanning slide 20. FIG. 5 show the coin in the moment of its introduction, where it is positioned above the upper side edge of V-shaped recess.

The depth A of the recess 76a corresponds to the elevational distance between the center axis' of the apertures 34 and 50, respectively. That means that when the coin 14 is moving entirely down into the V-shaped recess 76a of the scanning slide 20, and the main slide 22 is pushed down, the scanning slide 20 will be displaced to an extent A upwardly along the main slide, so that the apertures 34 and 50 will be positioned mutually coaxially, and consequently can be moved together downwardly before the projection 36.

We claim:

1. A coin operated lock for delivering a locking means secured in said lock after the introduction of a means of payment, such as a coin, into said lock, said lock comprising, a first chamber for receiving the locking means, securing members for securing the locking means in the first chamber, a second chamber for receiving said means of payment, delivering members for delivering the locking means after the introduction of the means of payment, a scanning member associated with the second chamber, said scanning member adapted to scan, during a displacement movement, the sizes of the introduced means of payment in the direction of the displacement movement of the scanning member, and corresponding to at least one of such sizes, said scanning member being provided with at least one recess for receiving a releasing member attached to the first chamber, said scanning member adapted to move into engagement with said recess so as to cause release of the locking means to permit removal thereof from the first chamber, said scanning member including a measuring member and a movement member, said measuring and movement members being coupled together so as to move at the same time and in relation to each other, the measuring member being provided with said at least one recess, said movement member including a passage for receipt of the releasing member in engagement connection in the passage and said at least one recess when they occupy a displacement position aligned with each other.

2. A coin operated lock as claimed in claim 1 in which the releasing member is shaped as a pivot lever having a first projection protruding to one side of the pivot lever for engagement with said passage and said at least one recess, and a second projection protruding to the opposite side of the pivot lever so as to secure said locking means during rotation of the releasing member to protrude into the first chamber.

3. A coin operated lock as claimed in claim 1 or 2 in which the releasing member is actuated by a spring which is active in the line of movement of the locking means and which at the same time protrudes into the line of movement of the movement member.

4. A coin operated lock as claimed in claim 1 in which an auxiliary member is attached to the releasing member for releasably locking the releasing member in the position of respectively securing the locking means and releasing the locking means.

5. A coin operated lock as claimed in claim 4 in which the releasing member is actuated by a spring positioned in the first chamber, said first chamber being formed so as to effect an ejecting impulse on the locking means.

6. A coin operated lock as claimed in claim 1 or 2 in which the scanning member has a terminating surface extending transverse to the displacement path thereof and is adapted to form, in the resting position of the locking means, a limitation surface for a chamber for receiving said means of payment, said scanning member being provided with a groove to receive a circumferential part of the means of payment.

* * * * *